US007594545B2

(12) United States Patent
Love

(10) Patent No.: US 7,594,545 B2
(45) Date of Patent: Sep. 29, 2009

(54) SYSTEM AND METHODS FOR PREVENTING IGNITION AND FIRE VIA A MAINTAINED HYPOXIC ENVIRONMENT

(76) Inventor: Ronald Jay Love, 52 Connecticut St., Cranford, NJ (US) 07016

( * ) Notice: Subject to any disclaimer, the term of this patent is extended or adjusted under 35 U.S.C. 154(b) by 387 days.

(21) Appl. No.: 11/339,428

(22) Filed: Jan. 25, 2006

(65) Prior Publication Data

US 2007/0169947 A1 Jul. 26, 2007

(51) Int. Cl.
*A62C 2/00* (2006.01)
*A62C 3/00* (2006.01)
*A62C 35/00* (2006.01)
*A62C 37/00* (2006.01)

(52) U.S. Cl. ..... 169/45; 169/11; 169/46; 169/56; 169/60

(58) Field of Classification Search ..... 169/11, 169/16, 43, 45, 46, 54, 56, 60; 62/78, 640
See application file for complete search history.

(56) References Cited

U.S. PATENT DOCUMENTS 4,378,920 A * 4/1983 Runnels et al. ..... 244/135 R
4,807,706 A 2/1989 Lambertsen et al.
5,388,413 A 2/1995 Major et al.
6,418,752 B2 * 7/2002 Kotliar ..... 62/640
6,502,421 B2 * 1/2003 Kotliar ..... 62/640
6,560,991 B1 5/2003 Kotliar
6,672,397 B2 1/2004 Taylor
6,739,399 B2 5/2004 Wagner et al.
6,739,400 B2 * 5/2004 Lessi et al. ..... 169/46
6,840,331 B2 1/2005 Sant'Angelo
2002/0023762 A1 * 2/2002 Kotliar ..... 62/640
2002/0070035 A1 * 6/2002 Grabow et al. ..... 169/16

* cited by examiner

*Primary Examiner*—Darren W Gorman
(74) *Attorney, Agent, or Firm*—Rita C. Chipperson; Law Offices of Rita C. Chipperson, P.C.

(57) ABSTRACT

Disclosed are systems and methods for preventing ignition and fire in maintained hypoxic environments. In one aspect of the present invention, the hypoxic environment is initially obtained via an initial release of large quantities of nitrogen and is thereafter maintained via use of nitrogen generation equipment, thereby eliminating the need for onsite nitrogen storage. In other aspects of the present invention, the hypoxic environment is initially obtained via the same equipment used to maintain the hypoxic environment. Additionally, venting is provided to prevent over-pressurization of the hypoxic environment or to otherwise regulate the pressure of the environment. Furthermore, ultra-sophisticated fire detection system is implemented to detect invisible by-product materials as they degrade during pre-combustion stages of an incipient fire, thereby detecting a fire as early as six hours prior to ignition. Finally, networked embodiments of such systems are disclosed for remote monitoring and maintenance of such systems and methods.

47 Claims, 8 Drawing Sheets

SYSTEM AND METHODS FOR PREVENTING IGNITION AND FIRE VIA A MAINTAINED HYPOXIC ENVIRONMENT

BACKGROUND OF THE INVENTION

Embodiments of the present invention generally relate to systems and methods for preventing ignition and fire via a maintained hypoxic environment. More specifically, the present invention relates to systems and methods for preventing ignition and fire via maintained hypoxic environments, wherein said hypoxic environment may be initially created via an initial release of large quantities of nitrogen, wherein venting is provided to prevent over-pressurization and/or a maintained pressure of the hypoxic environment, and wherein an ultra-sophisticated fire detection system is implemented to detect invisible by-product materials as they degrade during pre-combustion stages of an incipient fire, thereby detecting a fire as early as six hours prior to ignition. In some embodiments of the present invention, such systems may be implemented with zero onsite nitrogen storage.

Many systems and methods have been created to extinguish fires that occur within confined spaces. Many such systems and methods have been created to maintain an environment conducive to human and animal respiration during the extinguishing process. In its most simplistic form, such systems introduce an inert gas into the confined space. In one such system, an apparatus that produces an unlimited amount of cooled, oxygen depleted air is provided. The apparatus may be incorporated into an existing heating or air conditioning system within a home or business such that when a fire occurs the existing heating or cooling system introduces the oxygen deleted air into the building thereby extinguishing the fire. Alternatively, the system may be mobile such that a transmission conduit transfers the air to the fire. The mobile system may also include a flame retardant tarp for isolation of the fire during the extinguishing process.

In a similar system, a means for transporting and delivering a breathable inert gas such as nitrogen, carbon dioxide, or mixtures of both is provided. In this system, the inert gas is transported in liquid or compressed form to maximize the volume of the inert gas transported to the location of the fire. In one embodiment of this system, the liquid is then converted to a gas by a heat exchanger prior to being applied to the fire via conduit and lance systems. In another embodiment, the liquid is applied directly to the fire via conduit and lance systems such that the heat of the fire causes the liquid to volatize. Alternatively, the inert gas could be provided using nitrogen generating devices such as pressure swings or membrane systems.

Other such systems include methods of suppressing fires in addition to methods of extinguishing fires. In one such system, the amount of oxygen in a facility is reduced to a level that is below the normal oxygen concentration of air while still maintaining an adequate level to allow normal respiration to occur. This may be accomplished via an apparatus for supplying inert gases such as nitrogen, carbon dioxide, or helium to an environment from onsite storage containers housing such gases. This allows the oxygen content in the facility to be decreased thereby restricting combustion. Such systems usually also include a method for feeding oxygen into the facility in the event that the oxygen concentration becomes too low to sustain respiration. Additionally, in one such system, the oxygen content of the facility is reduced below the level needed to sustain respiration in the event that a fire occurs.

In a similar system, a hyperbaric hypoxic environment is created after a fire occurs. In this system, the hyperbaric hypoxic environment is created in only a portion of the facility such that this portion may be used as an emergency escape route from the facility. This environment may be created in a staircase or a separate tunnel specifically designed for evacuation purposes. The creation of hyperbaric hypoxic environment prevents the fire from spreading to the designated escape route, ensuring evacuation. In one such system, protection against biological and chemical warfare and contaminants is also provided by filtering the ambient air in the escape route prior to evacuation.

BRIEF SUMMARY OF THE INVENTION

In one aspect of the present invention, a system for maintaining a hypoxic environment within a space is provided. This system includes at least one nitrogen supply device for supplying nitrogen; a distribution system coupled to the at least one nitrogen supply device for distributing the nitrogen throughout the space; at least one oxygen monitoring device; at least one pressure relief device for performing at least one of the group consisting of positively pressurizing the hypoxic environment relative to an environment located external to the space, maintaining a static pressure of the space, and combinations thereof; at least one pressure monitoring device for measuring a pressure within the space; a control system coupled to the at least one nitrogen supply device, the at least one oxygen monitoring device, the at least one pressure relief device, and the at least one pressure monitoring device, the control system programmed to monitor the hypoxic environment and control the at least one nitrogen supply device and the at least one pressure relief device such that the hypoxic environment is maintained at a predetermined oxygen concentration setpoint and at a predetermined pressure setpoint; and at least one fire detection device coupled to the control system for detecting a fire prior to an ignition of the fire, wherein the at least one nitrogen supply device minimizes nitrogen storage by supplying nitrogen generated from compressed air.

In another aspect of the present invention, a method of maintaining a hypoxic environment within a space is provided. This methods includes the steps of: monitoring an oxygen concentration level of the hypoxic environment; supplying nitrogen to the space upon a fall in the oxygen concentration level relative to an oxygen concentration level setpoint wherein the supplying includes the sub-steps of: generating nitrogen from compressed air and distributing the nitrogen throughout the space; terminating the supply of the nitrogen upon a rise in the oxygen concentration level relative to the oxygen concentration level setpoint; measuring a pressure within the space; controlling at least one pressure relief device for maintaining a pressure of the space at a pressure setpoint in response to the pressure measured within the space; and detecting a fire prior to an ignition of the fire.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments that are presently preferred. It should be understood, however, that the invention is not limited to the precise arrangements and instrumentalities shown. In the drawings.

DETAILED DESCRIPTION OF THE INVENTION

Figure 1:
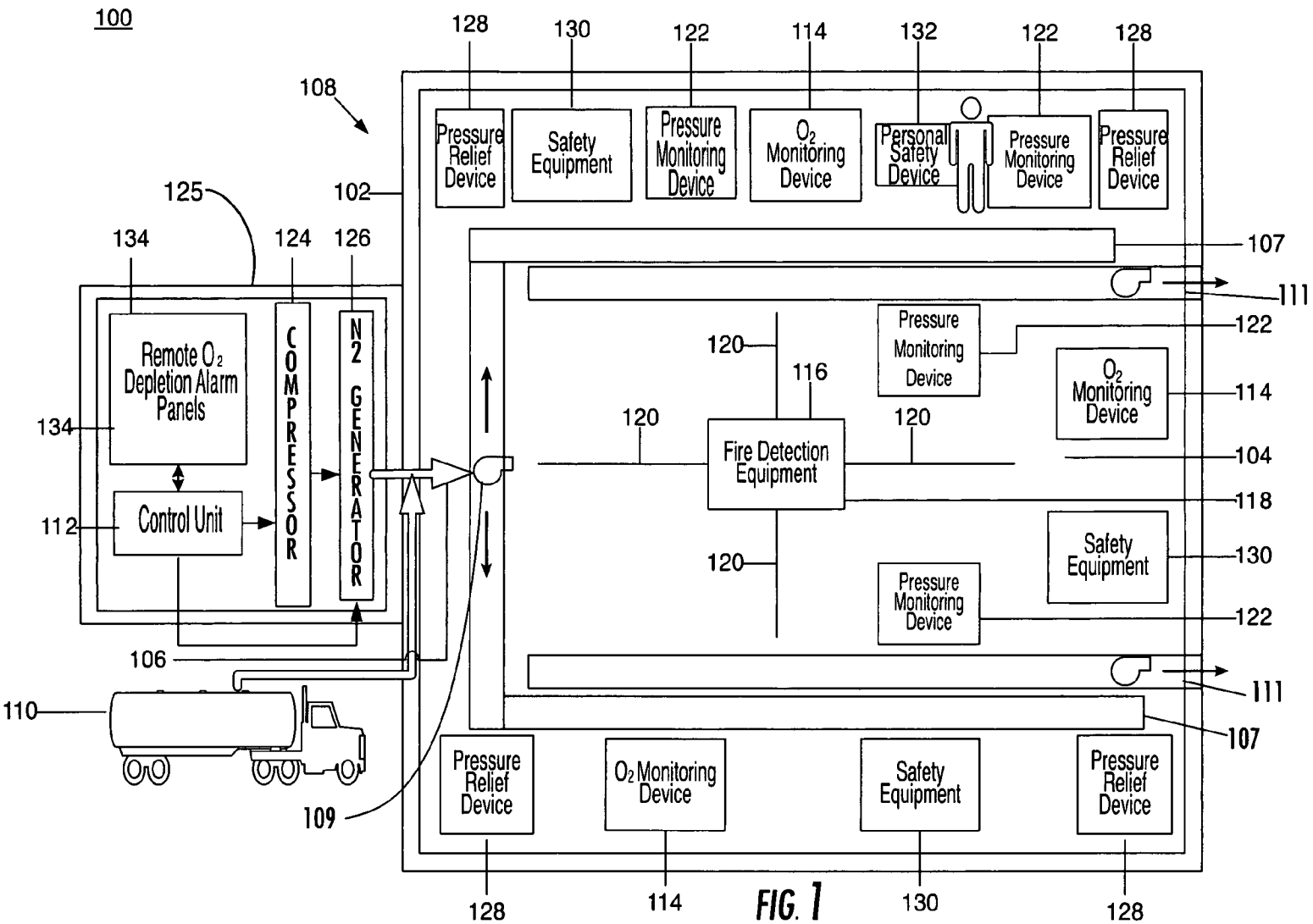
FIG. 1 depicts a top view of an ignition prevention system installed in a facility in accordance with one embodiment of the present invention.
Figure 2A:
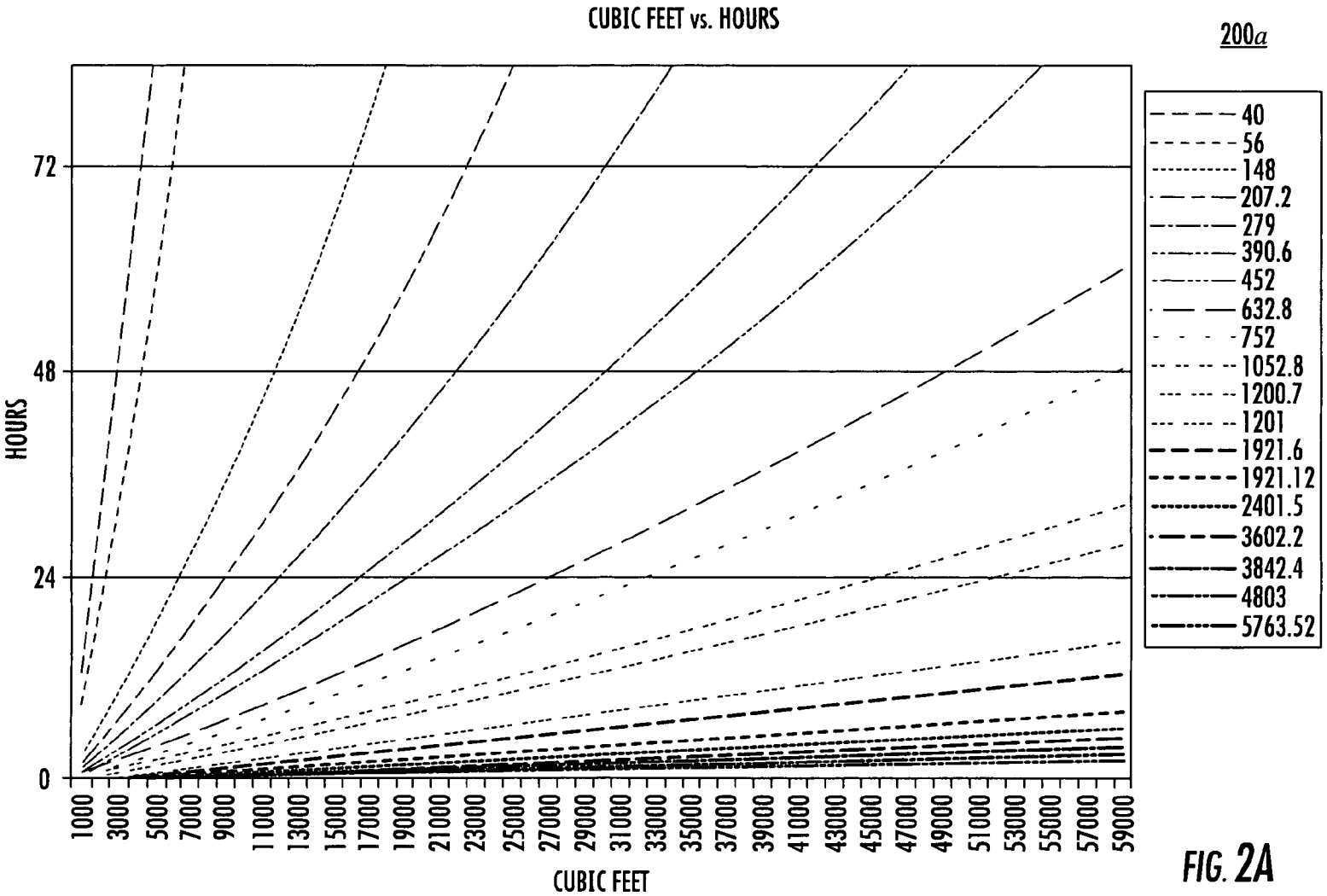
FIG. 2A depicts a chart of the time required to reduce the oxygen concentration level from approximately 21% to approximately 15% in daily increments versus the volume of the environment to be purged for a variety of nitrogen flow rates.
Figure 2B:
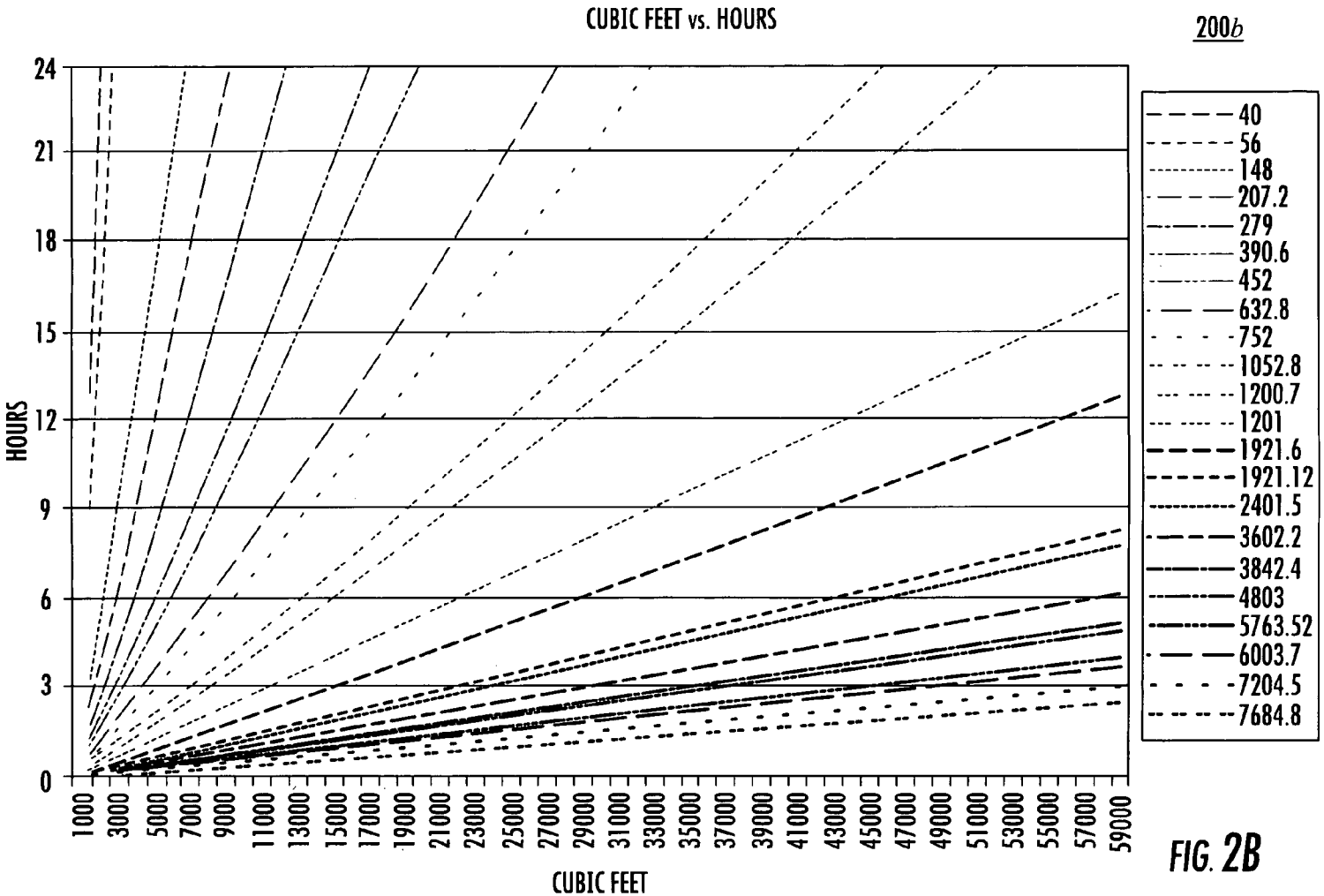
FIG. 2B depicts a chart of the time required to reduce the oxygen concentration level from approximately 21% to approximately 15% in three-hour increments versus the volume of the environment to be purged for a variety of nitrogen flow rates.
Figure 2C:
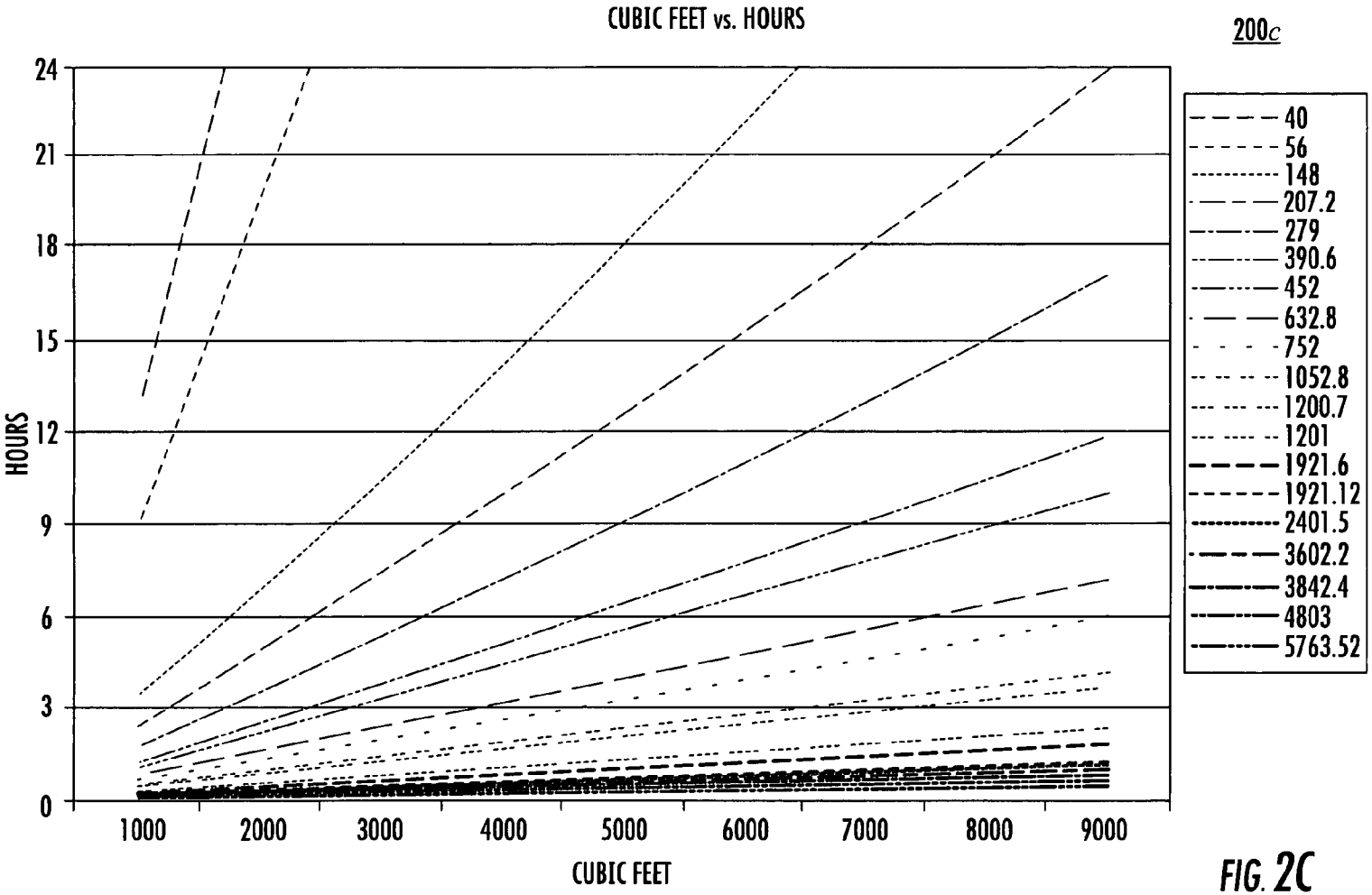
FIG. 2C depicts a chart of the time required to reduce the oxygen concentration level from approximately 21% to approximately 15% in three-hour increments versus the volume of an environment less than 9,000 cubic feet to be purged for a variety of nitrogen flow rates.
Figure 2D:
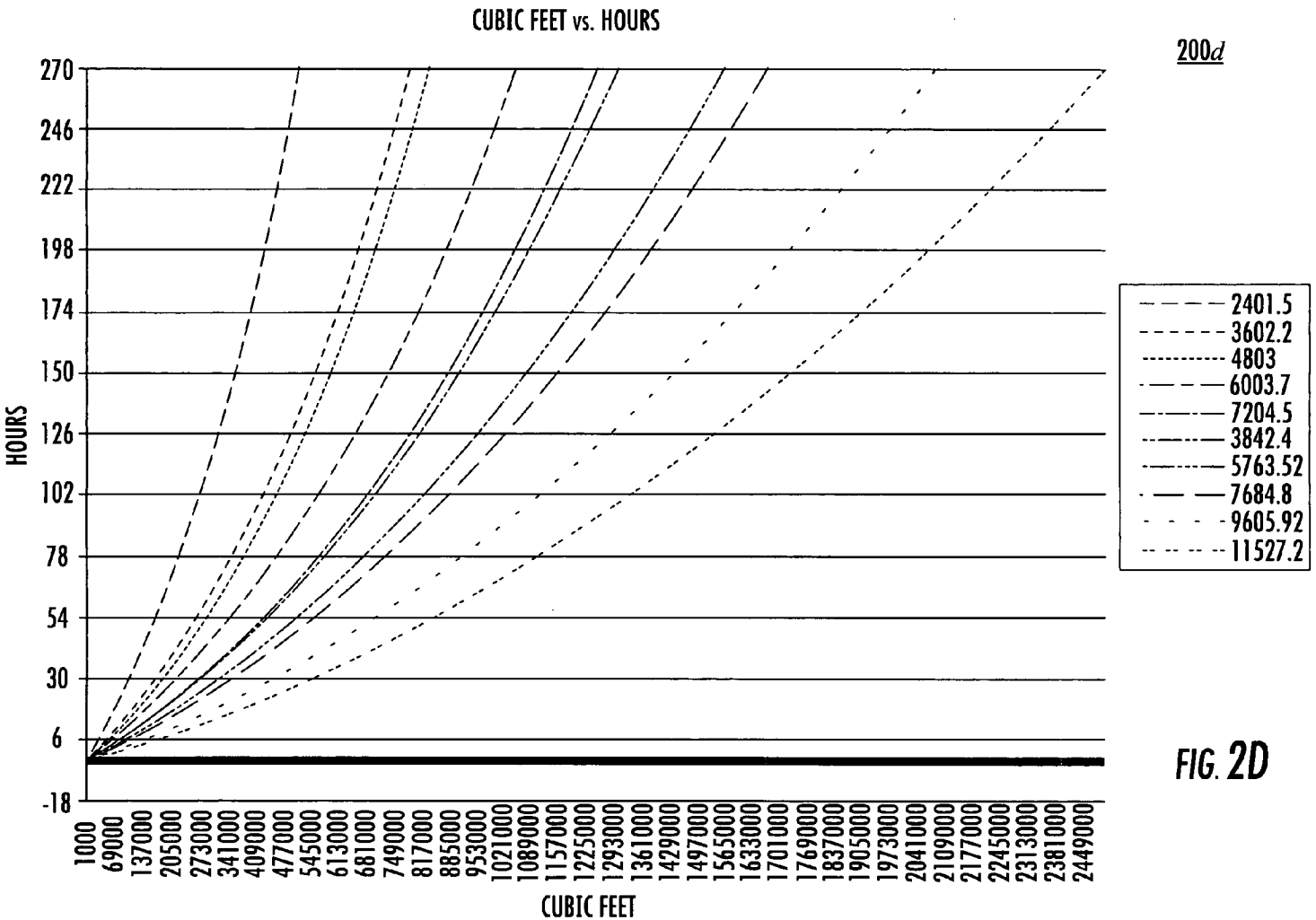
FIG. 2D depicts a chart of the time required to reduce the oxygen concentration level from approximately 21% to approximately 15% in twenty-four-hour increments versus the volume of the environment to be purged for a variety of nitrogen flow rates.

Referring first to FIG. 1, illustrated is a diagram of an exemplary embodiment of ignition prevention system 100 installed to prevent and/or minimize ignition and/or fire within maintained environment 104, which is located within walls 102 of the facility. In one aspect of the present invention, nitrogen is initially released into maintained environment 104 such that a hypoxic environment is created therein. Thereafter, ignition prevention system 100 continuously maintains the environment at reduced oxygen levels for the purpose of preventing and/or minimizing ignition and/or fire while providing a safe breathing environment for individuals working in maintained environment 104.

Preferably, the facility, vessel, or the like in which ignition prevention system 100 will be installed should be capable of, or modified to, maintain the hypoxic environment at a slightly positive pressure relative to the environment located external to the facility, vessel, or the like. Such positive pressurization minimizes the quantity of nitrogen required to maintain the hypoxic environment by preventing the infiltration of non-hypoxic air from outside the facility, vessel, or the like. When ignition prevention system 100 is installed in an existing facility, an analysis and, if necessary, a retrofit of the existing facility ventilation systems may be performed to prepare the facility for installation of an ignition prevention system such as ignition prevention system 100 such that positive pressurization is achieved. Although analysis and/or retrofit of the ventilation of a facility are preferred, ignition prevention system 100 may also be utilized in facilities without analysis or retrofit of the existing ventilation systems without departing from the scope of the present invention.

After installation of the components of ignition prevention system 100 (as depicted in FIG. 1 and as discussed in greater detail below), the initial hypoxic environment is created via introduction of large quantities of nitrogen such as pure nitrogen into maintained environment 104. Such initial quantities of nitrogen may be supplied by virtually any nitrogen holding mechanism such as a liquid tank truck, containers of liquid nitrogen, or the like. In one embodiment of the present invention, the nitrogen is discharged into maintained environment 104 via connection of the liquid nitrogen holding mechanism to piping 106 and its associated distribution system as described in greater detail below. However, alternate methods of initially supplying nitrogen to maintained environment 104 may be substituted without departing from the scope hereof.

Piping 106 is designed such that the nitrogen is dispersed as uniformly as possible throughout maintained environment 104. In some aspects of the present invention, piping 106 delivers nitrogen into the existing heating, ventilating, and/or air-conditioning ductwork 107. Such delivery allows a fan associated with the heating, ventilating, and/or air-conditioning unit such as supply fan 109 to thoroughly mix the nitrogen with the ventilation air and to properly disperse the nitrogen-enriched air into maintained environment 104. Simultaneously, near equal amounts of existing air in maintained environment 104 are removed by an exhaust or return air fan such as fans 111 such that the air within the environment is continuously exchanged with nitrogen-enriched air. However, other methods of dispersing nitrogen and exchanging the nitrogen-enriched air with the existing air (e.g., custom ventilation systems) may be substituted without departing from the scope hereof.

Initial reduction of the nitrogen level of maintained environment 104 via such temporary mechanisms eliminates the need for voluminous storage of nitrogen cylinders at facility 108. For example, to achieve the goals of the present invention for a facility approximately 20 meters wide by 50 meters deep by 6.5 meters high, permanent storage of approximately 300 nitrogen cylinders each having a weight of approximately 30 tons would be required. The systems and the methods of the present invention eliminate and/or minimize the quantity of liquid nitrogen stored in or at the facility.

Once the environment of a facility such as facility 108 has initially been reduced to the desired hypoxic level, the ignition prevention system of the present invention continuously maintains such level. In some embodiments of the present invention, the desired oxygen concentrations of the environment may be approximately 15.5%, which is healthy for most human occupants, yet prevents ignition of a fire for the vast majority of common, flammable materials. Alternatively, the desired oxygen concentration may be approximately 12%, which prevents ignition of a fire for all materials. However, varying oxygen concentration setpoints may be maintained by the systems and methods of the present invention without departing from the scope hereof.

In an embodiment of the present invention, control unit 112 performs the monitoring and control associated with ignition prevention system 100 based upon execution of a process such as process 300, as discussed in greater detail below with respect to FIGS. 3A and 3B. In some embodiments of the present invention, such processes are performed by processors and electrical or electronic components under the control of computer-readable and computer-executable instructions such as programmable logic controllers ("PLCs") and the like. The computer-readable and computer-executable instructions reside, for example, in data storage features, memory, registers, and other components of a computer system, microprocessor, control unit, or the like. However, control unit 112 may be virtually any control unit capable of accepting inputs and generating outputs based upon an algorithm without departing from the scope of the present invention.

Figure 4:
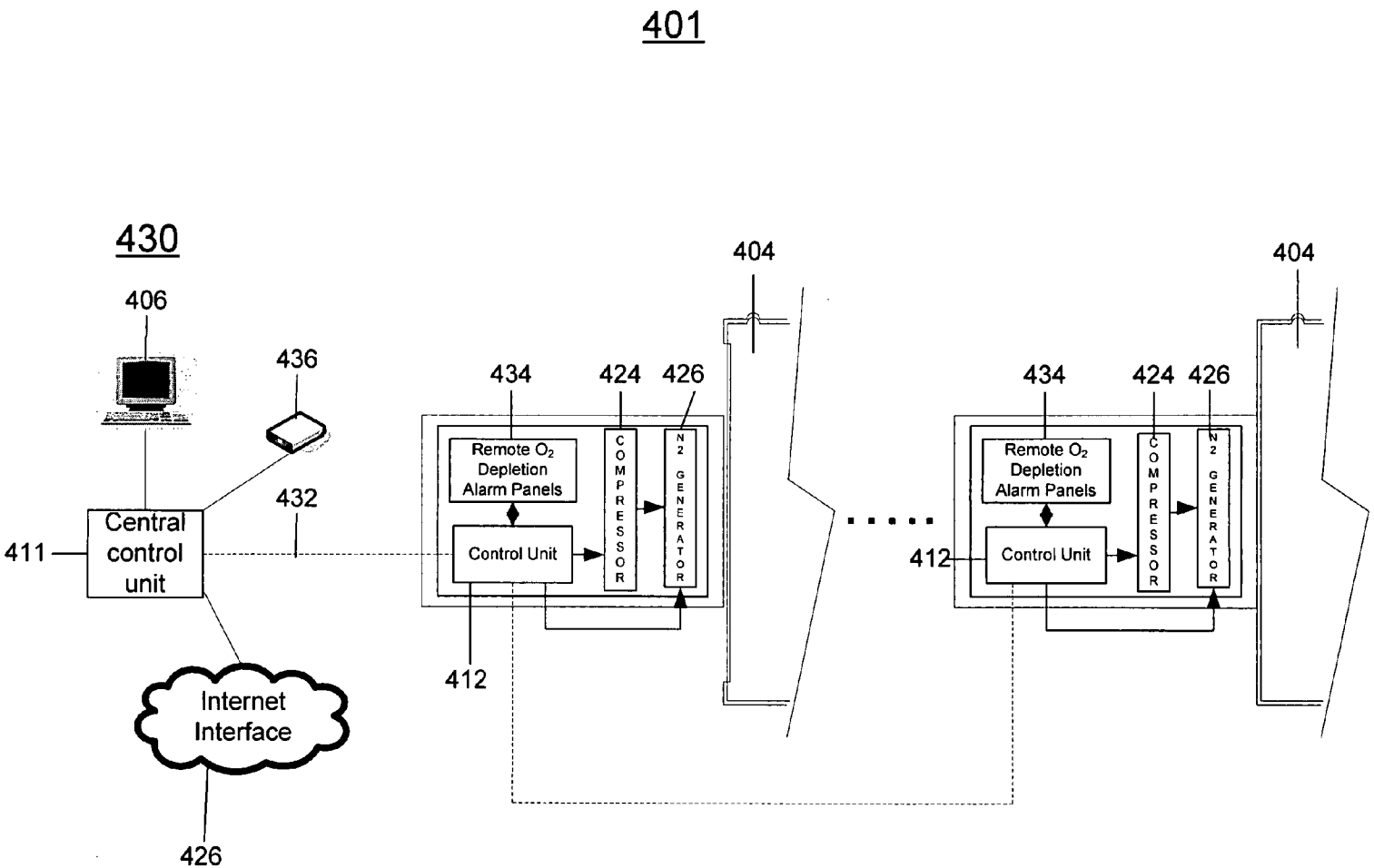
FIG. 4 depicts a networked ignition prevention system including a central monitoring station in accordance with an embodiment of the present invention.

Preferably, the process is an algorithm programmed based upon a user's requirements and downloaded to control unit 112 or a portion thereof. However, other methods of loading control unit 112 (e.g., burning or programming an interchangeable EPROM, re-programming an EEPROM, programming a microprocessor, etc.) may be incorporated without departing from the scope of the present invention. Thereafter, parameter changes, calibration values, and the like may be implemented via re-downloading or re-burning control unit 112, or a portion thereof, with a revised process, entering the data via a user interface integral to control unit 112, and/or entering the data via a networked computer of a ignition prevention user workstation such as ignition prevention user workstation 406 (FIG. 4).

Preferably, the process executed by control unit 112 receives input data from devices that are in communication with control unit 112 via hardwiring, wireless connection, communication interfaces, or the like. More specifically, in the embodiment of the present invention depicted in FIG. 1, control unit 112 receives data from one or more of oxygen monitoring devices 114 (e.g., oxygen concentration levels), pressure relief devices 128 (e.g., pressure relief device open/closed status, pressure relief device percentage open, etc.), and fire detection equipment 118 (e.g., byproducts of the pre-combustion stages of an incipient fire, smoke, fire, etc.). Furthermore, control unit 112 may control one or more of pressure relief devices 128 (e.g., command devices open, command devices closed, modulate devices to a specific open percentage level, etc.), compressor 124, and nitrogen generator 126.

In some embodiments of the present invention, one or more remote oxygen depletion alarm panels 134 are included. Such panel may be a display local to control unit 112 such as an integral LED or LCD. Or, alternatively, oxygen depletion alarm panel 134 may be a separate standalone panel in communication with control unit 112. Such panel may provide local audible and/or visual alarms upon a fall in the respective oxygen concentration level below the alarm setpoint via alarm devices such as flashing displays, alarm horns, sirens, flashing lights, etc. However, oxygen depletion alarm panels 134 are not required to achieve the goals of the present invention.

In some aspects of the present invention, the components of ignition prevention system 100 that are not installed within maintained environment 104 (e.g., control unit 112, compressor 124, nitrogen generator 126, and oxygen depletion alarm panel 134) may be housed in a dedicated room such as room 125 adjacent the maintained environment. Such location allows maintenance personnel to maintain, service, and/or monitor ignition prevention system 100 without disturbing maintained environment 104. In such embodiments, oxygen depletion alarm panel 134 notifies such maintenance personnel of a problem within maintained environment 104.

In one aspect of the present invention, control unit 112 receives oxygen information such as oxygen concentration levels from oxygen monitoring devices such as oxygen monitoring devices 114. Such information may be received by control unit 112 individually from each oxygen monitoring device 114 in the form of one or more binary signals (e.g., a change of state occurs on a fall or rise in oxygen levels above or below a predetermined setpoint), analog signals (e.g., a 4-20 milliampere ("ma") signal, a 0-10 volt direct current ("VDC") signal, etc.), pulsed signals, communication interfaces (e.g., Modbus), wireless signals, or the like. Or, alternatively, oxygen monitoring devices 114 may be connected to each other via one or more oxygen monitoring device communication buses, and such communication buses may be interfaced to control unit 112 via an open protocol, a communication interface, or the like. In systems incorporating the latter embodiment, ignition prevention system user workstation 406 (FIG. 4) of central monitoring station 430 may be programmed to provide a plethora of information received from the oxygen monitoring devices 114 (rather than only oxygen concentration levels) inexpensively as such information may be shared via a communication bus (rather than individual wiring for each piece of information).

In one embodiment of the present invention, oxygen monitoring devices 114 are strategically located throughout the maintained environment to ensure that every area of the maintained environment is accurately monitored. Typically, each oxygen monitoring device 114 includes an integral oxygen monitoring sensor such as a current limiting Zirconium oxide sensor cell for continuous monitoring of the maintained environment. Preferably, such sensors are fast acting and are capable of providing accurate measurements in environments having temperature, humidity, and pressure fluctuations. In some aspects of the present invention, an accuracy of plus or minus one percent of full scale is desirable, however, sensors having varying accuracies or varying types of oxygen sensors (e.g., electrochemical sensor cells) may be substituted without departing from the scope of the present invention.

In some aspects of the present invention, the oxygen concentration level is transmitted from each oxygen monitoring device 114 to control unit 112 via a scaled 4-20 mA signal, or, alternatively, any signal compatible with control unit 112 (e.g., a zero to ten VDC signal, a zero to twenty mA signal, a pulsed binary contact, a wireless signal, a communication interface, etc.). In some aspects of the present invention, in addition to transmitting oxygen concentration level data to control unit 112, each oxygen monitoring device 114 also displays this data on a display local to the respective oxygen monitoring device 114 such as an integral LED or LCD. In addition, oxygen monitoring devices 114 may provide local audible and/or visual alarms upon a fall in the respective oxygen concentration level below the alarm setpoint via alarm devices such as flashing displays, alarm horns, sirens, flashing lights, etc. However, such local displays and/or alarms are not required to achieve the goals of the present invention. For example, such displays and/or alarms may not be required for an ignition prevention system installed in an unoccupied facility, a vessel, or the like.

However, when installed, inclusion of local displays and/or alarms allows employees or other individuals within facility 108 to independently monitor oxygen concentration levels. Such monitoring further allows such individuals to take the proper action upon a fall in the oxygen concentration level below the desired setpoint. In such an event, safety equipment 130 such as a self-contained breathing apparatus may be used by the individuals to achieve such safe responses including, but not limited to, safely exiting the facility, safely implementing evacuation procedures, etc. Safety equipment 130 may also be as required by the Occupational Safety and Health Administration ("OSHA") or local, state, or federal fire codes.

In some embodiments of the present invention, oxygen monitoring devices 114 are Air Check Oxygen Deficiency Monitors as manufactured by PureAire Monitoring Systems, Inc. However, virtually any device, sensor, or the like capable of sensing oxygen concentration levels and providing feedback regarding same to control unit 112 may be substituted without departing from the scope of the present invention.

In another aspect of the present invention, control unit 112 receives fire detection information from fire detection equipment such as fire detection equipment 118. In some embodiments of the present invention, fire detection equipment 118 is an ultra-sophisticated air sampling fire detection system capable of detecting a fire before it occurs. Such systems are capable of detecting humanly invisible by-product materials as they degrade during pre-combustion stages of an incipient fire. In some cases, an impending fire may be detected as early as six hours or more prior to ignition.

In one aspect of the present invention, fire detection equipment 118 continuously samples the maintained environment in the facility such as facility 108 to provide accurate detection of an incipient fire independent of air movement. In one embodiment of the present invention, during operation of ignition prevention system 100, air samples are continuously drawn from the maintained environment through a pipe network 120 connected to fire detection equipment 118 with the aid of a high efficiency aspirator. However, other methods and/or devices for detecting the byproduct materials of pre-combustion, smoke, fire, and the like may be substituted without departing from the scope hereof.

Upon detection of the by-product materials of the pre-combustion stages of an incipient fire or other items of concern (e.g., high temperature levels, products of combustion, etc.), fire detection equipment 118 transmits such information to control unit 112. Such transmission may occur in the form of one or more hardwired binary signals (e.g., a contact closure), hardwired analog signals (e.g., a 4-20 ma signal, a 0-10 VDC signal, etc.), pulsed signals, communication interfaces (e.g., Modbus, BACnet, etc.), wireless signals, or the like. Or, alternatively, fire detection equipment 118 may have one or more dedicated fire detection communication buses, and such communication buses may be interfaced to control unit 112 via an open protocol, a communication interface, or the like. In systems incorporating the latter embodiment, ignition prevention system user workstation 406 (FIG. 4) of central monitoring station 430 may be programmed to provide a plethora of information received from fire detection equipment 116 (rather than only fire alarms) inexpensively as such information may be shared via a communication bus (rather than individual wiring for each piece of information).

In some aspects of the present invention, in addition to transmitting fire detection information to control unit 112, fire detection equipment 116 also displays this data on a local display such as an integral LED or LCD. In addition, fire detection equipment 116 may provide local audible and/or visual alarms upon detection of an alarm condition via alarm devices such as flashing displays, alarm horns, sirens, flashing lights, etc. as required by local fire codes. However, such local displays and/or alarms are not required to achieve the goals of the present invention. For example, such displays and/or alarms may not be required for an ignition prevention system installed in an unoccupied facility, a vessel, or the like.

In some embodiments of the present invention, fire detection equipment 116 is a VESDA LaserScanner system. However, virtually any equipment capable of detecting fire, smoke, and/or the by-product materials of the pre-combustion stages of an incipient fire and providing feedback regarding same to control unit 112 may be substituted without departing from the scope of the present invention.

In some aspects of the present invention, fire detection equipment 118 may be pre-programmed to output a plurality of staged alarm levels to control unit 112. For example, in one embodiment of the present invention, the fire detection system provides four levels of alarm with adjustable thresholds. When fire detection equipment 118 senses a first stage alarm level (i.e., "ALERT"), it notifies control unit 112 that something out of the ordinary has been detected and may warrant investigation. For example, a first stage alarm level may indicate that the by-product materials of the pre-combustion stages of an incipient fire have been detected or that the smoke level in a monitored area is above normal. If fire detection equipment 118 senses a second stage alarm level (i.e., "ACTION"), it notifies control unit 112 that the smoke level in a monitored area has exceeded a predetermined setpoint and therefore action (e.g., smoke removal from the monitored area) is required. If fire detection equipment 118 senses a third stage alarm level (i.e., "FIRE1"), it notifies control unit 112 that a fire is imminent or in progress, and the appropriate procedures should be implemented (e.g., the facility should be evacuated). Finally, if fire detection equipment 118 senses a fourth stage alarm level (i.e., "FIRE2"), it notifies control unit 112 that a fire is in progress. However, when the systems and methods of the present invention are implemented, the possibility of third and fourth stage alarms is greatly minimized.

In some embodiments of the present invention, control unit 112 receives pressure information such as static pressure levels from pressure monitoring devices such as pressure monitoring devices 122. Such information may be received by control unit 112 individually from each pressure monitoring device 122 in the form of one or more binary signals (e.g., a change of state occurs on a fall or rise in static pressure above or below a predetermined setpoint), analog signals (e.g., a 4-20 ma signal, a 0-10 VDC signal, etc.), pulsed signals, communication interfaces (e.g., Modbus), wireless signals, or the like. Or, alternatively, pressure monitoring devices 122 may be connected to each other via one or more pressure monitoring device communication buses, and such communication buses may be interfaced to control unit 112 via an open protocol, a communication interface, or the like. In systems incorporating the latter embodiment, ignition prevention system user workstation 406 (FIG. 4) of central monitoring station 430 may be programmed to provide a plethora of information received from the pressure monitoring devices 122 (rather than only static pressure levels) inexpensively as such information may be shared via a communication bus (rather than individual wiring for each piece of information).

In one embodiment of the present invention, pressure monitoring devices 122 are strategically located throughout the maintained environment to ensure that every area of the maintained environment is accurately monitored. Typically, each pressure monitoring device 122 includes an integral pressure monitoring sensor such as a capacitive pressure transducer for continuous monitoring of the maintained environment. Preferably, such sensors are fast acting and are capable of providing accurate measurements in environments having temperature, humidity, and pressure fluctuations. In some aspects of the present invention, an accuracy of plus or minus one percent of full scale is desirable, however, sensors having varying accuracies or varying types of pressure sensors may be substituted without departing from the scope of the present invention.

In some aspects of the present invention, the static pressure is transmitted from each pressure monitoring devices 122 to control unit 112 via a scaled 4-20 mA signal, or, alternatively, any signal compatible with control unit 112 (e.g., a zero to ten VDC signal, a zero to twenty mA signal, a pulsed binary contact, a wireless signal, a communication interface, etc.). In some aspects of the present invention, in addition to transmitting static pressure data to control unit 112, each pressure monitoring devices 122 also displays this data on a display local to the respective pressure monitoring devices 122 such as an integral LED or LCD. In addition, pressure monitoring devices 122 may provide local audible and/or visual alarms upon a fall in the respective static pressure below the alarm setpoint via alarm devices such as flashing displays, alarm horns, sirens, flashing lights, etc. However, such local displays and/or alarms are not required to achieve the goals of the present invention. For example, such displays and/or alarms may not be required for an ignition prevention system installed in an unoccupied facility, a vessel, or the like.

In some embodiments of the present invention, pressure monitoring devices 114 are high accuracy static pressure sensors as manufactured by Setra Systems, Inc. However, virtually any method of sensing static pressure levels and providing feedback regarding same to control unit 112 may be substituted without departing from the scope of the present invention.

The process executed by control unit 112 receives the data discussed above and uses such data for purposes such as generating alarms for the occupants and/or maintenance personnel of facility 108, controlling compressor 124 and/or nitrogen generator 126, controlling pressure relief devices 128, and the like. However, the collected data may also be used for other purposes without departing from the scope hereof.

In one aspect of the present invention, nitrogen generator 126 is a Balston® Nitrogen Generator, such as the HFXO series of nitrogen generators, as manufactured by Parker Hannifin Corporation. Use of such a generator for nitrogen generator 126 eliminates or minimizes the need for onsite nitrogen storage. Such nitrogen generator 126 produces virtually pure, commercially sterile nitrogen from a compressed air supply such as that provided by a standard air compressor. Nitrogen generator 126 creates such nitrogen by separating compressed air into two air streams through use of membrane separation technology. A first air stream is virtually pure nitrogen and the second air stream is oxygen-rich with carbon dioxide and other trace gases. The former air stream is contained within a hollow fiber membrane until it flows through an outlet port of the nitrogen generator, and the latter air stream is discharged through a permeative port. However, alternate nitrogen generators, including those requiring onsite nitrogen storage, may be substituted without departing from the scope of the present invention.

In one aspect of the present invention, nitrogen generator 126 may be modular to accommodate future expansion of ignition prevention system 100. Such modularity allows ignition prevention system 100 to be expanded as necessary upon enlargement of the facility, removal of large equipment from the facility (thereby creating a greater volume of air), and the like. In such embodiments, nitrogen generator 126 may be a Balston® Nitrogen Generator selected from the Nitrosource series of nitrogen generators, as manufactured by Parker Hannifin Corporation. However, alternate nitrogen generators having modular features may be substituted without departing from the scope of the present invention.

The size of nitrogen generator 126 is dependent upon a plurality of factors such as, but not limited to, the volume of air in the facility, vessel, or the like ("V"), time available to reduce the oxygen concentration to the desired level ("T"), the desired oxygen concentration level for the maintained environment, quantity of air changes required to initially achieve the desired oxygen concentration level ("$R_{PURGE}$"), leakage rate of the facility, vessel, or the like, quantity of air changes required to maintain the environment at the desired oxygen concentration level at a specific leakage rate, and the flow rate of nitrogen supplied by nitrogen generator 126.

Since a typical facility will have continuous leakage of air, at a minimum, nitrogen generator 126 must be capable of supplying a sufficient quantity of nitrogen to maintain the oxygen concentration levels at the desired oxygen setpoint. That is, nitrogen is supplied to the maintained environment in order to purge oxygen therefrom such that a low, predetermined level of oxygen may be maintained. The required purging may be measured as a total quantity of air changes required per day (i.e., the quantity of times the volume of the room must be completely exchanged per day)("R"). R will vary with the leakage rate of the maintained environment. For example, to maintain an environment at an oxygen concentration of 15%, R will be 0.095 for a 5% leakage rate ("$R_{5\%}$") and 0.18 for a 10% leakage rate ("$R_{10\%}$"). Based upon R, the minimum nitrogen flow rate for nitrogen generator 126 ("$F_{min}$") may be calculated via the following equation:

$$F_{MIN}=VR/T_{MAINTAIN\ DAILY} \quad \text{(Eq. 1)}$$

wherein V equals the volume of air in the facility in cubic feet, vessel, or the like and $T_{MAINTAIN\ DAILY}$ equals the time in hours required to achieve the total quantity of air changes per day as required by R. Since the maximum period of time in which R may be achieved is one day, or 24 hours, $F_{min}$ for a facility having a volume of 10,000 cubic feet and a leakage rate of 5% is 39.58 $ft^3$/hour. Consequently, for this example, nitrogen generator 126 must be capable of supplying a minimum nitrogen flow rate of approximately 40 cubic feet per hour ("CFH"). Or, if a 10% error is applied to the calculated result, the minimum nitrogen flow rate is 44 CFH. Equation 1 may be used to adequately size nitrogen generator 126 for a facility, vessel, or the like of any volume and any leakage rate. However, embodiments of the present invention are envisioned in which nitrogen generators 126 having a greater capacity than $F_{min}$ are incorporated. Although such a selection may increase a user's first cost since the price of nitrogen generator 126 typically increases with a corresponding increase in flow rate, it is likely to reduce the runtime of the compressor such as air compressor 124, which may result in a longer equipment life cycle for same.

Other criteria may also be considered when sizing nitrogen generator 124. For example, in some embodiments of the present invention, the initial discharge of liquid nitrogen into the maintained environment may be eliminated. In such an embodiment, the oxygen level of the environment to be maintained may be reduced from the approximately 21% oxygen concentration level found in ambient air to the desired setpoint by enabling ignition prevention system 100 and allowing it to slowly reduce the oxygen concentration levels until the desired oxygen concentration level setpoint is achieved. Thereafter, ignition prevention system 100 will operate to maintain the environment at the desired oxygen concentration level.

In such an embodiment, it is useful to calculate the total time required to reduce the oxygen concentration level from the ambient air percentage (i.e., approximately 21%) to the desired setpoint ("$T_{PURGE\ TOTAL}$") to ensure that such a reduction may be achieved within an acceptable timeframe. In such an embodiment, a nitrogen generator must be selected to have a higher nitrogen flow rate than that calculated via equation 1, since this equation provides a minimum flow rate capable of offsetting leakage if nitrogen generator 126 runs continuously for a 24-hour period. That is, nitrogen generator 126 must be sized to spend a portion of each day offsetting the rise in the oxygen concentration level due to leakage and a portion of each day further reducing the oxygen concentration level.

Without taking into account nitrogen generated to offset leakage, $T_{PURGE\ TOTAL}$ may be calculated via the following equation:

$$T_{PURGE\ TOTAL}=(V/F)*R_{PURGE} \quad \text{(Eq. 2)}$$

wherein V equals the volume of air in the facility, vessel, or the like in cubic feet, F equals the nitrogen flow rate in cubic feet per hour, and $T_{PURGE\ TOTAL}$ equals the time in hours required to achieve the total quantity of air changes required to reduce the oxygen concentration level from the ambient air percentage to the desired oxygen setpoint. For example, if an environment will be maintained at an oxygen concentration level of approximately 15%, the initial reduction in oxygen level is approximately 6% (assuming an ambient oxygen level concentration of approximately 21%). $R_{PURGE}$ for a 6% reduction in oxygen concentration level is approximately 0.47. Therefore, continuing our previous example of a 10,000 cubic foot facility requiring a minimum nitrogen flow rate of approximately 40 CFH, such a system would require approximately 117.5 hours to obtain an initial environment having a 15% oxygen concentration level.

Alternatively, $T_{PURGE\ TOTAL}$ may be calculated via the following equation:

$$T_{PURGE\ TOTAL} = (V/F)*\ln\left(\frac{C_i - C_p}{C_f - C_p}\right) \quad \text{(Eq. 3)}$$

wherein V equals the volume of air in the facility, vessel, or the like in cubic feet, F equals the nitrogen flow rate in cubic feet per hour, $C_i$ equals the initial oxygen concentration of the facility (e.g., 21% for ambient air) measured in percent, $C_p$ equals the purge gas oxygen concentration measured in percent, and $C_f$ equals the desired oxygen concentration of the facility (e.g., 15%) measured in percent.

During implementations of the present invention in which the initial oxygen reduction phase must be limited to a specific time period ("$T_{INITIAL\ PHASE}$"), the minimum nitrogen flow rate may be calculated by first determining the hours per day during which nitrogen generator 126 must reduce oxygen levels ("$T_{PURGE\ DAILY}$") to achieve $T_{INITIAL\ PHASE}$ and second, recalculating equation 1 based upon the hours of each day during which nitrogen generator 126 may run to offset losses due to leakage ("$T_{MAINTAIN\ DAILY}$"). "$T_{PURGE\ DAILY}$" may be determined by the following equation:

$$\text{"}T_{PURGE\ DAILY}\text{"}=T_{PURGE\ TOTAL}/\text{"}T_{INITIAL\ PHASE}\text{"} \quad \text{(Eq. 4)}$$

wherein $T_{PURGE\ DAILY}$ and $T_{PURGE\ TOTAL}$ are measured in hours and $T_{INITIAL\ PHASE}$ is measured in days. Therefore, continuing our example from above and assuming that the initial oxygen reduction must occur within a one week time period, the time per day that may be devoted to reducing the oxygen concentration level equals 117.5 hours divided by 7 days, or approximately 17 hours. Thereafter, "$T_{MAINTAIN\ DAILY}$" may be calculated by the following equation:

$$\text{"}T_{MAINTAIN\ DAILY}\text{"}=24\text{ hours}-\text{"}T_{PURGE\ DAILY}\text{"} \quad \text{(Eq. 5)}$$

wherein both variables are measured in hours. Continuing our example, "$T_{MAINTAIN\ DAILY}$" equals 24 hours-17 hours, or 7 hours. At this point, the minimum nitrogen flow required to reduce the oxygen concentration level in the environment to the desired level in the desired timeframe while simultaneously offsetting losses may be calculated via equation 1 as discussed in greater detail above using 7 hours for the variable $T_{MAINTAIN\ DAILY}$. For a facility having a volume of 10,000 cubic feet and a leakage of 5%, the minimum nitrogen flow rate required to achieve the aforementioned objectives is approximately 136 CFH.

In the illustrated example, the minimum nitrogen flow rate required to both reduce the oxygen concentration level to the desired setpoint and maintain the environment at the oxygen concentration level setpoint is more than triple the minimum flow rate required to solely maintain the environment. Consequently, in this particular example, it may behoove the facility owner to perform an initial release of liquid nitrogen into the environment from a nitrogen storage mechanism as discussed above to minimize the initial cost of ignition prevention system 100. However, in other embodiments such as those in which $T_{INITIAL\ PHASE}$ is a more lengthy time period, it may be less expensive to allow ignition prevention system 100 to both reduce the oxygen concentration level to the desired setpoint and maintain the environment at the oxygen concentration level setpoint to save the cost associated with initially supplying nitrogen to the environment. The optimal method of implementing the present invention varies based upon all of the aforementioned factors, however, equations 1 through 5 may be utilized to determine the optimal system for each specific facility and/or situation.

Charts such as those depicted in FIGS. 2A through 2D may be created based upon equation 1 to aid in the design of ignition prevention system 100, sizing of nitrogen generator 126 and/or compressor 124, and the like. Chart 200*a* depicts the time required to reduce the oxygen concentration level from approximately 21% to approximately 15% in daily increments along the Y-axis versus the volume of the facility, vessel, or the like to be purged, which is represented on the X-axis for a variety of nitrogen flow rates. Chart 200*a* assumes a leakage rate of 5%. Similarly, chart 200*b* depicts the time required to reduce the oxygen concentration level from approximately 21% to approximately 15% in three hour increments along the Y-axis versus the volume of the facility, vessel, or the like to be purged, which is represented on the X-axis for a variety of nitrogen flow rates. Chart 200*b* assumes a leakage rate of 5%. In addition, chart 200*c* depicts the time required to reduce the oxygen concentration level from approximately 21% to approximately 15% in three hour increments along the Y-axis versus the volume of the facility, vessel, or the like to be purged for facilities having a volume less than 9000 cubic feet, which is represented on the X-axis for a variety of nitrogen flow rates. Chart 200*c* assumes a leakage rate of 5%. Finally, chart 200*d* depicts the time required to reduce the oxygen concentration level from approximately 21% to approximately 15% in twenty-four hour increments along the Y-axis versus the volume of the facility, vessel, or the like to be purged, which is represented on the X-axis for a variety of nitrogen flow rates. Chart 200*d* assumes a leakage rate of 10%.

Referring back to FIG. 1, in some embodiments of the present invention, nitrogen generator 126 is supplied by compressor 124, which may be a standard air compressor as known in the art. In some embodiments of the present invention, compressor 124 may be a rotary screw compressor such as the GX series manufactured by Atlas Copco, however, other compressors may be substituted without departing from the scope of the present invention. The size of compressor 124 will be determined based upon factors such as the desired nitrogen flow rate of nitrogen generator 126, the desired runtime of compressor 124, etc. For example, if nitrogen generator 126 has been sized based upon 24-hour daily operation (to achieve reduction of the oxygen concentration level to the desired setpoint and/or maintenance of the environment at the oxygen concentration level setpoint), compressor 124 must be designed for continuous operation (i.e., compressor 124 should not be of the type designed for approximately 66% runtime or the like). However, if nitrogen generator 126 has been sized based for 16-hour daily operation or less, compressor 124 may be the type designed for approximately 66% runtime.

In addition, the output pressure of compressor 124 may be sized as necessary to achieve the minimum nitrogen flow rate. For example, a nitrogen generator receiving 145 pounds per square inch ("PSI") from a compressor is capable of providing a higher nitrogen flow rate than the same nitrogen generator receiving 100 PSI from a compressor having a lower output pressure. However, compressors having output pressures other than 100 or 145 PSI may be substituted without departing from the scope of the present invention.

In some aspects of the present invention, compressor 124 will include one or more of an air compressor, an air dryer, and air filtering devices. Air dryers are necessary to eliminate condensation in the compressed air, which may arise during continuous use of the air compressor. Air filtering devices such as carbon filters may be required to filter out impurities in the compressed air such as oil vapor. However, devices other than air dryers and air filtering devices may be used in conjunction with compressor 124 without departing from the scope of the present invention.

Ignition prevention system 100 also includes pressure relief devices 128. In one aspect of the present invention, pressure relief devices 128 are automatic control dampers, vents, or the like modulated open or closed by control unit 112 as necessary to maintain the static pressure setpoint of facility 108, as sensed by pressure monitoring devices 122. In another aspect of the present invention, pressure relief devices 128 are standalone devices (i.e., they are not controlled by an external controller such as control unit 112). In such embodiments of the present invention, pressure monitoring devices 122 may be eliminated (since they are not required for control of pressure relief devices 128) or they may be retained for monitoring purposes. In some such embodiments of the present invention, pressure relief devices 128 are Pressure Relief Vent model no. 94160 as manufactured by Shand & Jurs. However, alternate pressure relief devices may be substituted without departing from the scope of the present invention. Pressure relief devices 128 also function as a safety device that relieves excess pressure to prevent over-pressurization of maintained environment 104.

In one aspect of the present invention, pressure relief devices 128 are mounted at a low point in facility 108 and nitrogen is supplied into facility 108 via piping 106 and an associated distribution network such as ventilation ductwork or the like at a high point (e.g., below the ceiling, along the topmost end of the walls, etc.). Such configuration minimizes the length of time required to perform a complete air exchange. However, other configurations of ignition prevention system 100 and/or other locations of pressure relief devices 128 and piping 106 may be substituted without departing from the scope hereof.

As an added safety feature, each employee or other individual entering facility 108 or the maintained environment may be required to wear or carry personal safety devices 132. In some embodiments of the present invention, personal safety devices 132 are portable oxygen monitors having audible and/or visual alarms or the like that inform a wearer of dangerous conditions within facility 108 (such as reduced oxygen concentration levels). However, other personal safety devices may be added or substituted without departing from the scope hereof.

The design of ignition prevention system 100 minimizes the square footage required to house ignition prevention system 100 by eliminating, or at least minimizing, the necessity of nitrogen containers or dewars for a few reasons. One, since the initial introduction of large quantities of nitrogen to the facility's environment are provided from temporary and removable nitrogen holding mechanisms such as liquid tank truck 110, removable containers, and the like, there is no need to house nitrogen containers for this purpose. Furthermore, once the environment has reached the desired hypoxic levels, the pressurization of the facility prevents unnecessary discharge of nitrogen and/or unnecessary infiltration of oxygen, thereby minimizing the quantity of nitrogen required to maintain the environment at its hypoxic level. Additionally, incorporation of a nitrogen generator such as nitrogen generator 126 (i.e., one that does not require a nitrogen supply), further eliminates and/or minimizes the need for local nitrogen storage. In addition to reducing the square footage required to house an ignition prevention system such as ignition prevention system 100, elimination of local nitrogen storage also eliminates the cost and inconvenience of such storage. That is, the owner and/or user of the ignition prevention system is not required to maintain an account with a nitrogen supplier, check nitrogen levels, request nitrogen deliveries, etc., thereby facilitating the ease of use and maintenance of the ignition prevention system. Although it is desirable to eliminate and/or minimize local nitrogen storage, the systems and methods of the present invention may be used in conjunction with such storage without departing from the scope of the present invention.

Figure 3A:
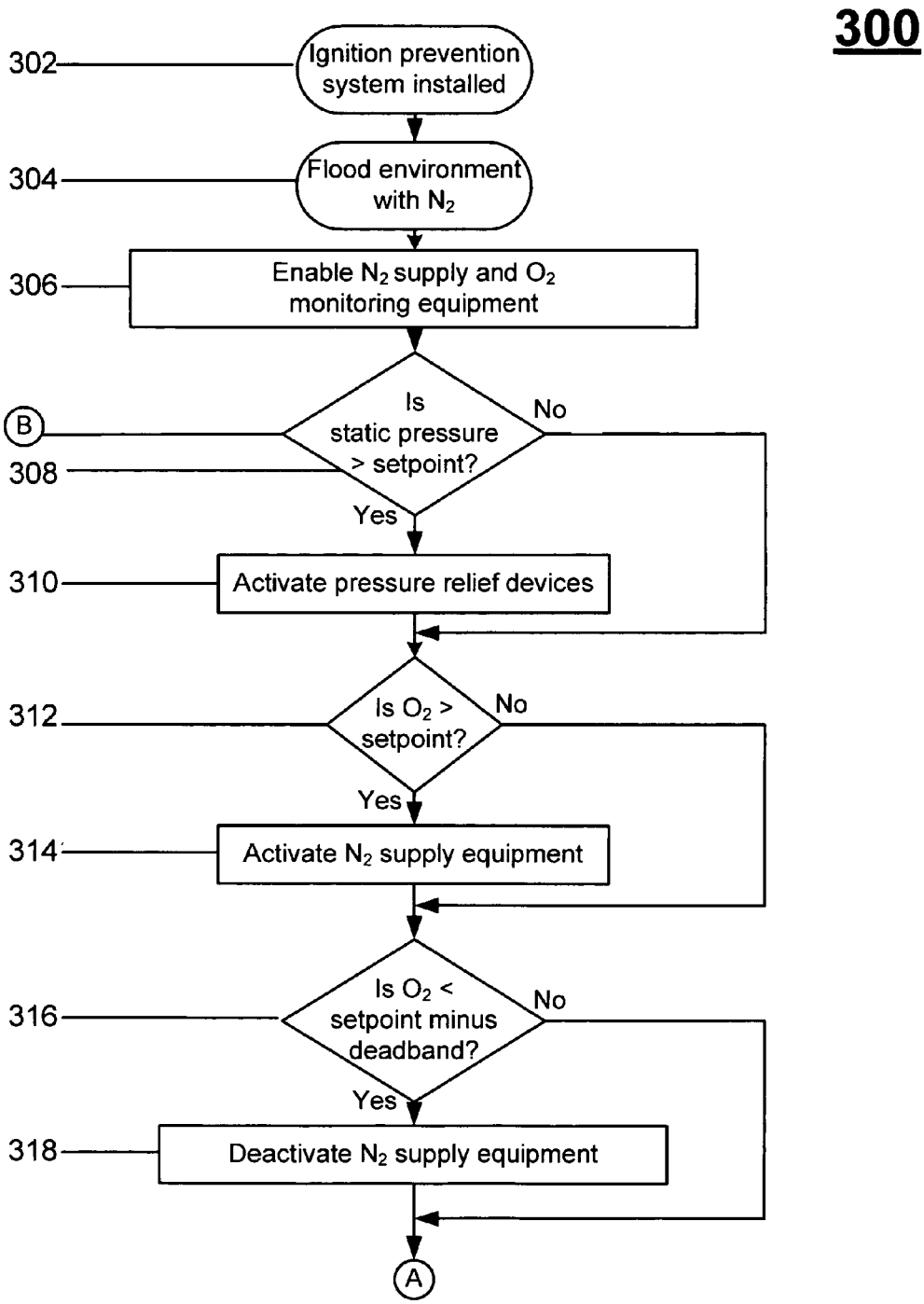
FIG. 3A depicts a flow chart of a method of ignition prevention in accordance with one embodiment of the present invention.
Figure 3B:
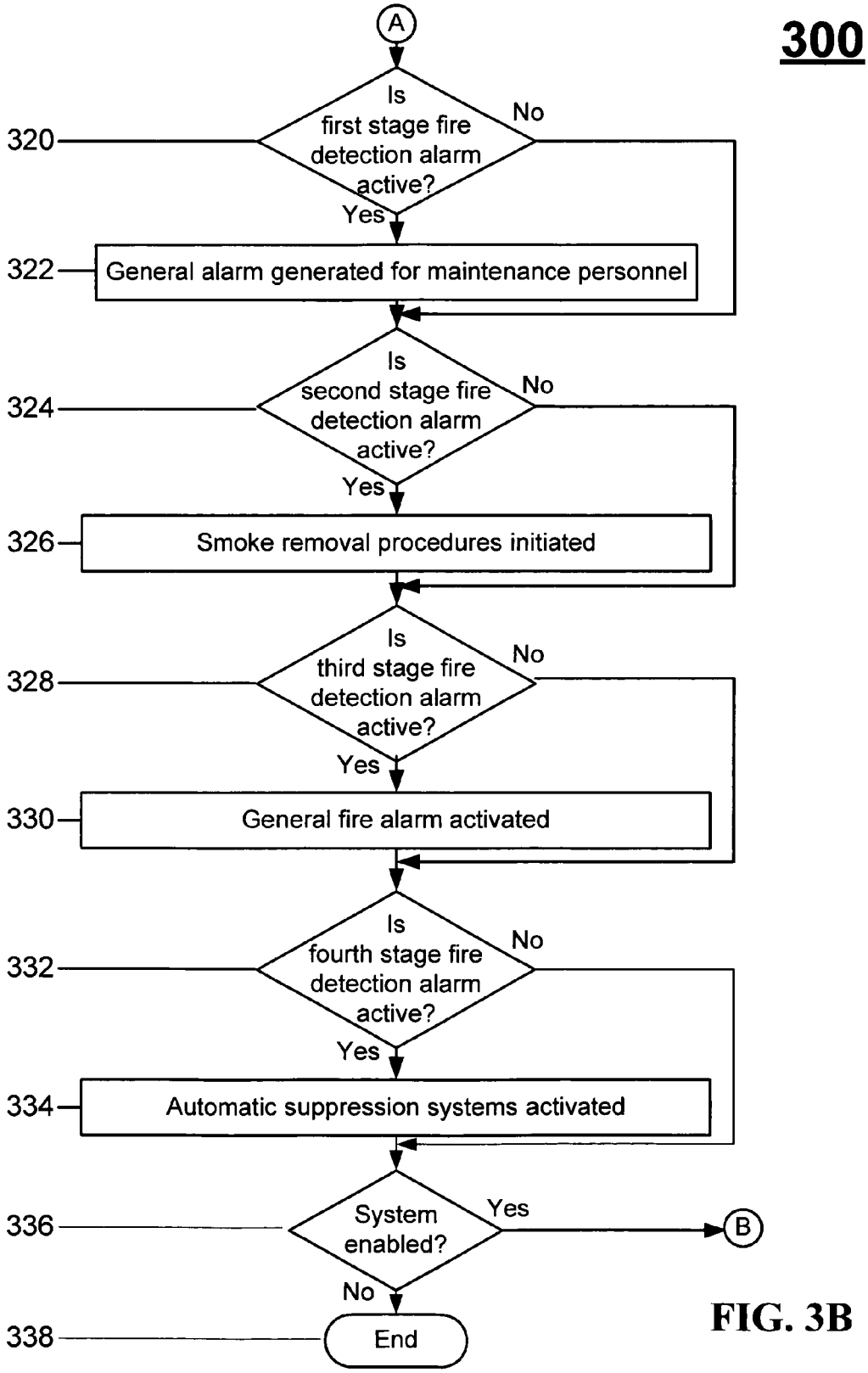
FIG. 3B depicts a continuation of the flow chart depicted in FIG. 3A in accordance with one embodiment of the present invention.

Referring now to FIG. 3A, illustrated is a flow diagram of one embodiment of a process for preventing and/or minimizing ignition and/or fire while providing a safe breathing environment for individuals working in a facility such as facility 108. Process 300 begins at 302. For example, at 302, an ignition prevention system such as ignition prevention system 100 (FIG. 1) has been installed within a facility such as facility 108. Such installation is as discussed above with respect to FIG. 1. In addition to installation of the required system components, such installation may include installation and/or retrofit of existing pressurization and/or ventilation systems to ensure that the facility is properly pressurized.

After installation of ignition prevention system 100, process 300 proceeds to 304, at which the environment within the facility is flooded with nitrogen to create a hypoxic environment having a desired oxygen concentration level (e.g., 15%). Such initial quantities of nitrogen may be supplied by virtually any nitrogen holding mechanism such as a liquid tank truck, containers of liquid nitrogen, or the like. In one embodiment of the present invention, the nitrogen is discharged into the maintained environment via connection of the liquid nitrogen holding mechanism to distributed piping. Such piping may disperse the nitrogen into the facility's heating, ventilating, and/or air-conditioning system to evenly disperse the nitrogen while removing the non-hypoxic air. Or, alternatively, the oxygen concentration level of the maintained environment may be reduced via supply of nitrogen from a nitrogen generator or other form of nitrogen supplying equipment.

Process 300 then proceeds to 306. At the conclusion of 304, the reduction in the oxygen concentration level of the hypoxic environment has been reduced from its ambient level to the desired level. Therefore, at 306, the nitrogen supply equipment (e.g., nitrogen generator, air compressor, air dryer, etc.) and the oxygen monitoring equipment is enabled such that process 300 may maintain the hypoxic environment at its desired oxygen concentration level by controlling the nitrogen supply equipment in response to a rise in the oxygen concentration level. Process 300 then proceeds to 308.

At 308, the static pressure of the facility is determined. If, at 308, the static pressure is less than or equal to the predetermined static pressure setpoint, process 300 proceeds to 312. However, if at 308, the static pressure is greater than the setpoint, process 300 proceeds to 310 prior to proceeding to 312. At 310, pressure relief devices are activated (e.g., opened) as necessary to prevent over-pressurization of the facility and/or to maintain the facility at the desired static pressure. In some embodiments of the present invention in which this process is automated, opening of the pressure relief devices involves modulation or two-position control of such devices by the control unit. However, in other embodiments in which this process is standalone, the change in static pressure exerted on the pressure relief device causes the device to modulate as required. Process 300 then proceeds to 312.

At 312, process 300 queries the oxygen concentration in the facility. If, at 312, the oxygen concentration is less than or equal to the predetermined oxygen setpoint (i.e., the desired concentration of oxygen in the facility), process 300 proceeds to 316. However, if, at 312, the oxygen level is greater than the oxygen setpoint, process 300 proceeds to 314 prior to proceeding to 316. At 314, nitrogen supply equipment and any associated equipment (e.g., compressor, air dryer, etc.) are activated to increase the concentration of nitrogen within the maintained environment, thereby decreasing the oxygen concentration of same. Process 300 then proceeds to 316.

At 316, process 300 queries the oxygen concentration in the facility. If, at 316, the oxygen concentration is greater than or equal to the predetermined oxygen setpoint minus a deadband (i.e., an acceptable variance from the oxygen setpoint in which the maintained environment is safe to breathe for individuals therein), process 300 proceeds to 320. However, if at 316, the oxygen level is less than the oxygen setpoint minus the deadband, process 300 proceeds to 318 prior to proceeding to 320. At 318, nitrogen supply equipment and any associated equipment (e.g., compressor, air dryer, etc.) are deactivated to immediately cease supply of nitrogen to the maintained environment, thereby facilitating an increase in the oxygen concentration of same. Process 300 then proceeds to 320.

At 320, process 300 queries the first stage fire detection alarm. If, at 320, the first stage fire detection alarm is inactive, process 300 proceeds to 324. However, if at 320, the first stage fire detection alarm is active, process 300 proceeds to 322 prior to proceeding to 324. The first stage fire detection alarm may be programmed to indicate that the by-product materials of the pre-combustion stages of an incipient fire have been detected or that the smoke level in a monitored area is above normal. At 322, a general alarm for maintenance personnel is generated to inform them of the potential condition such that it may be investigated.

At 324, process 300 queries the second stage fire detection alarm. If, at 324, the second stage fire detection alarm is inactive, process 300 proceeds to 328. However, if at 324, the second stage fire detection alarm is active, process 300 proceeds to 326 prior to proceeding to 328. The second stage fire detection alarm may be programmed to indicate that the smoke level in a monitored area has exceeded a predetermined setpoint and therefore action (e.g., smoke removal from the monitored area) is required. That is, the second stage fire detection alarm is set to detect a higher smoke level than the first stage fire detection alarm, indicating that the incipient fire risk or smoke level has reached a more severe level. At 326, smoke removal procedures are initiated.

At 328, process 300 queries the third stage fire detection alarm. If, at 328, the third stage fire detection alarm is inactive, process 300 proceeds to 332. However, if at 328, the third stage fire detection alarm is active, process 300 proceeds to 330 prior to proceeding to 332. The third stage fire detection alarm may be programmed to indicate that a fire is imminent or in progress. At 330, a general fire alarm is activated and the appropriate procedures are implemented (e.g., evacuation of the facility).

At 332, process 300 queries the fourth stage fire detection alarm. If, at 332, the fourth stage fire detection alarm is inactive, process 300 proceeds to 336. However, if, at 322, the third stage fire detection alarm is active, process 300 proceeds to 334 prior to proceeding to 336. The fourth stage fire detection alarm may be programmed to indicate that a fire is in progress. At 336, the general fire alarm remains active, the appropriate procedures are implemented, and automatic suppression systems (e.g., halon, sprinkler systems, etc.) are activated.

Process 300 then proceeds to 336, at which the ignition prevention system is queried to determine whether it is still enabled. If yes, process 300 returns to 308. If no, process 300 proceeds to 338, at which the process ends. If the ignition prevention system is disabled, all nitrogen supply equipment and any associated equipment is disabled.

Turning next to FIG. 4, depicted is networked ignition prevention system 400 including multiple control units 412 networked to each other and to one or more of central control unit 411 and ignition prevention user workstation 406. In the depicted embodiment, one control unit 412 is provided for each monitored environment 404, and a user may monitor and control the ignition prevention systems associated with each control unit 412 and its associated equipment (e.g., nitrogen generator, compressor, pressure relief devices, etc.) either locally from the respective control unit 412's user interface or remotely from central monitoring station 430, the latter of which may include one or both of modem 436 and Internet interface 428.

Each control unit 412 has features and characteristics similar to control unit 112 as described above with respect to FIG. 1. In this scenario, each control unit 412 is connected to equipment such as nitrogen generator 426, compressor 424, and remote oxygen depletion panels 434, and each control unit 412 is in communication with oxygen monitoring devices, pressure monitoring devices, pressure relief devices, and the like such as described above with respect to control unit 112 of FIG. 1. Each control unit 412 maintains the oxygen concentration level of its respective maintained environment 404 via control of nitrogen generator 426 and its associated equipment in response to the reported oxygen concentration levels. Also, each control unit 412 is capable of controlling static pressure in the maintained environment via control of the pressure relief devices in response to the sensed static pressures. Furthermore, each control unit 412 receives indications from the fire detection equipment if the by-product materials of the pre-combustion stages of an incipient fire, smoke, fire, or the like are sensed such that the respective ignition prevention system may provide the proper warnings, alarms, or the like and/or implement responsive action.

However, in addition to the features and characteristics of control unit 412, the networking of each control unit 412 to one or more ignition prevention user workstations 406 via one or more communication buses 432 allows bi-directional communications to occur between all networked components. Such bi-directional communication enhances the safety and ease with which control unit 412 and its respective ignition prevention system 400 may be monitored and controlled.

In this embodiment of the present invention, one or more ignition prevention systems associated with each control unit 412 may be monitored and controlled quickly, safely, and easily by a single user. This aspect of the present invention is particularly advantageous for use in an environment housing a large quantity of maintained environments 404 and having limited personnel to patrol individual maintained environments 404. A single user located at ignition prevention user workstation 406 may monitor all alarms for all ignition prevention systems 400 while simultaneously monitoring oxygen concentration levels, fire detection alarms, static pressure levels, and the like and adjusting or overriding individual parameters for each ignition prevention system 400. Such alarms may include, but are not limited to, first, second, third, and fourth stage fire detection alarms, low oxygen concentration levels, high building static pressure, system disabled alarms, control unit malfunction alarms, communication failure alarms, measured oxygen out-of-range alarms, and the like.

Additionally, one or more of the aforementioned alarms may be programmed for automatic disposition. For example, one or more specific alarms may be programmed for automatic printing at ignition prevention user workstation 406. Or, alternatively, one or more specific alarms may be programmed for automatic transmission via electronic mail from a ignition prevention user workstation 406 to a device such as a remote personal computer, handheld personal digital assistant ("PDA"), cellular telephone, alphanumeric pager, digital pager, etc. Or, in yet another alternate embodiment, one or more specific alarms may be programmed for transmission via a short haul modem to a non-electronic mail paging system. Many other methods of alarm disposition other than those specifically enumerated herein may be incorporated without departing from the scope of the present invention.

In addition to receiving alarms, users of ignition prevention systems 400 may perform all monitoring and control from any ignition prevention user workstation 406 for a specific ignition prevention system as if the user were standing at its respective control unit 412. For example, a user may override the oxygen concentration level and/or static pressure setpoints as necessary to achieve the goals of the facility. Or, a user may modify the permanent programmed data such as the method of transmitting alarms, required actions upon generation of a specific alarm, setpoints, and the like. Users may also override or control ignition prevention system devices. For example, users may remotely enable or disable devices such as compressor 424, nitrogen generator 426, and pressure relief devices (not shown). Furthermore, calibration values (e.g., oxygen sensor calibration values) may also be entered via ignition prevention user workstation 406.

In some embodiments, modem 436 is included. Modem 436 may be coupled to any one of ignition prevention user workstation 406, central control unit 411, and/or control unit 412. A telephone line is also coupled to modem 436 to connect it to a public communication system such as a telephone network. This connection allows a user that is remote from both the ignition prevention user workstation 406 and control unit 412 to connect to the associated ignition prevention system by placing a telephone with a personal computer to the networked ignition prevention system 401. Upon a successful connection, a user may perform all monitoring and control as if the user were seated at an ignition prevention user workstation 406.

Similarly, embodiments are envisioned that include Internet interfaces 428 (e.g., cable modem, DSL modem, wireless router, Ethernet cable, etc.). Internet interface 428 may be coupled to any one of ignition prevention user workstation 406, central control unit 411, and/or control unit 412. This connection allows a user that is remote from both the ignition prevention user workstation 406 and control unit 412 to connect to the associated ignition prevention system by accessing a web site programmed to access networked ignition prevention system 401. Upon successful connection to the web site, a user may perform all monitoring and control as if the user were seated at a ignition prevention user workstation 406.

In yet another embodiment, networked ignition prevention 401 includes a network having an open protocol such as BACnet™, LonWorks®, or the like. Such open protocols maximize the possibility and ease with which networked ignition prevention 401 may be interfaced to other existing or future networks. This interface allows data and control functions to be shared between the interfaced networks, thereby providing a more global method of using the present invention at a lower initial cost. For example, the networked ignition prevention 401 may be interfaced to a new or existing building management system ("BMS") network to allow the operator workstations or other user interfaces available on the BMS to access and/or control the data and devices available in networked ignition prevention system 401. Such access and control may be performed without the addition of operator workstations or other user interfaces specific to networked ignition prevention system 401. However, other interfaces may be substituted without departing from the scope of the present invention.

Although embodiments have been discussed herein in which devices are hardwired to control units and network communication buses are hardwired between networked devices, any such wiring discussed herein may be replaced with a wireless connection and associated transmitters and receivers without departing from the scope of the present invention.

Furthermore, although embodiments have been discussed herein in which many devices are controlled by a control unit such as a programmable logic controller, such devices may also be controlled via electromechanical switches, relays, and the like wired directly to the associated sensors. For example, nitrogen generation equipment may be controlled directly by a single oxygen monitoring device, or a plurality of oxygen monitoring devices hardwired together to provide one uniform signal to the nitrogen generation equipment without departing from the scope hereof.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A system for maintaining a hypoxic environment within a space comprising:

at least one nitrogen supply device for supplying nitrogen;

a distribution system coupled to said at least one nitrogen supply device for distributing said nitrogen throughout said space;

at least one oxygen monitoring device;

at least one pressure relief device for performing at least one of the group consisting of relieving excess pressure in said hypoxic environment, positively pressurizing said hypoxic environment relative to an environment located external to said space, maintaining a static pressure of said space, and combinations thereof;

at least one pressure monitoring device for measuring a pressure within said space;

a control system coupled to said at least one nitrogen supply device, said at least one oxygen monitoring device, said at least one pressure relief device, and said at least one pressure monitoring device, said control system programmed to monitor said hypoxic environment and control said at least one nitrogen supply device and said at least one pressure relief device such that said hypoxic environment is maintained at a predetermined oxygen concentration setpoint and at a predetermined pressure setpoint; and at least one fire detection device coupled to said control system for detecting a fire prior to an ignition of said fire, wherein said at least one nitrogen supply device minimizes nitrogen storage by supplying nitrogen generated from compressed air.

2. A system according to claim 1, wherein at least one air compressor generates said compressed air.

3. A system according to claim 1, wherein said positively pressurizing minimizes infiltration of non-hypoxic air into said hypoxic environment.

4. A system according to claim 3, wherein said minimization of said infiltration of said non-hypoxic air into said hypoxic environment minimizes a required capacity of said at least one nitrogen supply device.

5. A system according to claim 1, wherein said predetermined pressure setpoint is a static pressure setpoint.

6. A system according to claim 1, wherein said pressure relief device is an automatically controlled damper.

7. A system according to claim 1, wherein said hypoxic environment is initially created via introduction of a large quantity of nitrogen into said space from at least one of the group consisting of a removable liquid nitrogen holding mechanism, a temporary liquid nitrogen holding mechanism, a liquid nitrogen truck tank, a removable non-liquid nitrogen holding mechanism, a temporary non-liquid nitrogen holding mechanism, a non-liquid nitrogen truck tank, and combinations thereof.

8. A system according to claim 7, wherein said at least one of the group consisting of a removable liquid nitrogen holding mechanism, a temporary liquid nitrogen holding mechanism, a liquid nitrogen truck tank, a removable non-liquid nitrogen holding mechanism, a temporary non-liquid nitrogen holding mechanism, a non-liquid nitrogen truck tank, and combinations thereof are temporarily coupled to said distribution system.

9. A system according to claim 1, wherein said hypoxic environment is initially created via continuously operating said system until an oxygen concentration in said space falls from an ambient oxygen concentration level to a desired oxygen concentration level.

10. A system according to claim 9, wherein said desired oxygen concentration level is 15.5 percent.

11. A system according to claim 9, wherein said desired oxygen concentration level is adjustable.

12. A system according to claim 1, wherein said distribution system is at least one of the group consisting of piping, a forced air heating system, a ventilation system, an air-conditioning system, and combinations thereof.

13. A system according to claim 12, said system further comprising:

at least one supply fan associated with said at least one of the group consisting of said forced air heating system, said ventilation system, said air-conditioning system, and combinations thereof for mixing said nitrogen with said ventilation air to evenly disperse said nitrogen throughout said hypoxic environment.

14. A system according to claim 1, said system further comprising:

at least one of the group consisting of an exhaust fan, a return fan, and combinations thereof for removing a quantity of hypoxic air approximately equal to a quantity of supplied nitrogen-enriched air such that said hypoxic environment is continuously maintained.

15. A system according to claim 1, wherein said at least one nitrogen supply device includes at least one of the group consisting of a nitrogen generator, an air compressor, an air dryer, an air filter, and combinations thereof.

16. A system according to claim 1, said system further comprising:

at least one onsite nitrogen holding mechanism coupled to said distribution system for performing at least one of the group consisting of supplementing said at least one nitrogen supply device, operating as a backup to said at least one nitrogen supply device, initially creating said hypoxic environment, and combinations thereof.

17. A system according to claim 1, wherein maintaining said hypoxic environment minimizes a potential for at least one of the group consisting of fire, ignition of a fire, and combinations thereof.

18. A system according to claim 1, wherein said control unit is a programmable logic controller.

19. A system according to claim 1, wherein at least one of the group consisting of said at least one oxygen monitoring device, said at least one fire detection device, said at least one pressure monitoring device, and combinations thereof are interfaced to said control unit via at least one dedicated communications bus.

20. A system according to claim 1, said system further comprising:

at least one operator workstation for monitoring at least one of the group consisting of data associated with said oxygen monitoring devices, data associated with said fire detection devices, data associated with said pressure monitoring devices, data associated with said nitrogen supply devices, and combinations thereof;

wherein said at least one operator workstation is in communication with at least one of the group consisting of said oxygen monitoring devices, said fire detection devices, said pressure monitoring devices, said nitrogen supply devices, and combinations thereof.

21. A system according to claim 1, said system further comprising:

a remote communication interface coupled to said control unit.

22. A system according to claim 21, wherein said remote communication interface is at least one of the group consisting of a modem, an Internet interface, and combinations thereof.

23. A system according to claim 1, wherein a plurality of said control units is networked to each other.

24. A system according to claim 23, wherein said networking includes an open protocol.

25. A system according to claim 23, wherein said networking allows a first of said networked control units to be controlled via a second of said networked control units.

26. A system according to claim 1, wherein an alarm generated by said system is automatically transmitted to facility personnel via at least one of the group consisting of printing said alarm, electronically mailing said alarm, transmission of said alarm to a paging system.

27. A method of maintaining a hypoxic environment within a space comprising the steps of:

monitoring an oxygen concentration level of said hypoxic environment;

supplying nitrogen to said space upon a rise in said oxygen concentration level relative to an oxygen concentration level setpoint wherein said supplying includes the sub-steps of:

generating nitrogen from compressed air;

distributing said nitrogen throughout said space; and terminating said supply of said nitrogen upon a fall in said oxygen concentration level relative to said oxygen concentration level setpoint;

measuring a pressure within said space;

controlling at least one pressure relief device for maintaining a pressure of said space at a pressure setpoint in response to said pressure measured within said space; and detecting a fire prior to an ignition of said fire.

28. A method according to claim 27, said method further comprising:

installing at least one of the group consisting of a pressurization system, a ventilation system, and combinations thereof.

29. A method according to claim 27, said method further comprising:

retrofitting at least one of the group consisting of an existing pressurization system, an existing ventilation system, and combinations thereof.

30. A method according to claim 27, said method further comprising:

activating a fire detection alarm.

31. A method according to claim 30, wherein said fire detection alarm is activated upon an occurrence of at least one of the group consisting of said detecting a fire prior to said ignition of said fire, sensing by-product materials of pre-combustion stages of an incipient fire, sensing an abnormal smoke level in a monitored area, sensing that a smoke level has exceeded a predetermined setpoint, sensing an imminent fire, sensing an actual fire, and combinations thereof.

32. A method according to claim 27, wherein at least one air compressor generates said compressed air.

33. A method according to claim 27, wherein said controlling at least one pressure relief device minimizes infiltration of non-hypoxic air into said hypoxic environment.

34. A method according to claim 33, wherein said minimization of said infiltration of said non-hypoxic air into said hypoxic environment minimizes a required capacity of said at least one nitrogen supply device.

35. A method according to claim 27, wherein said pressure setpoint is a static pressure setpoint.

36. A method according to claim 27, wherein said pressure relief device is at least one of the group consisting of an automatically controlled damper, a vent, and combinations thereof.

37. A method according to claim 27, wherein said hypoxic environment is initially created via introduction of a large quantity of nitrogen into said space from at least one of the group consisting of a removable liquid nitrogen holding mechanism, a temporary liquid nitrogen holding mechanism, a liquid nitrogen truck tank, a removable non-liquid nitrogen holding mechanism, a temporary non-liquid nitrogen holding mechanism, a non-liquid nitrogen truck tank, and combinations thereof.

38. A method according to claim 37, wherein said hypoxic environment is initially created via continuously performing said method until an oxygen concentration in said space falls from an ambient oxygen concentration level to a desired hypoxic concentration level.

39. A method according to claim 27, wherein said oxygen concentration level setpoint is 15.5 percent.

40. A method according to claim 27, wherein said oxygen concentration level setpoint is adjustable.

41. A method according to claim 27, wherein said nitrogen is distributed throughout said space via at least one of the group consisting of piping, a forced air heating system, a ventilation system, an air-conditioning system, and combinations thereof.

42. A method according to claim 41, said method further comprising:

mixing said nitrogen with said ventilation air to evenly disperse said nitrogen throughout said hypoxic environment via at least one supply fan associated with said at least one of the group consisting of said forced air heating system, said ventilation system, said air-conditioning system, and combinations thereof.

43. A method according to claim 27, said method further comprising:

removing a quantity of hypoxic air approximately equal to a quantity of supplied nitrogen-enriched air such that said hypoxic environment is continuously maintained via at least one of the group consisting of an exhaust fan, a return fan, and combinations thereof.

44. A method according to claim 27, wherein maintaining said hypoxic environment minimizes a potential for at least one of the group consisting of fire, ignition of a fire, and combinations thereof.

45. A method according to claim 27, said method further comprising:

monitoring at least one of the group consisting of oxygen monitoring devices, fire detection devices, pressure monitoring devices, nitrogen supply devices, and combinations thereof via at least one operator workstation.

46. A method according to claim 27, said method further comprising:

remotely monitoring at least one of the group consisting of oxygen monitoring devices, fire detection devices, pressure monitoring devices, nitrogen supply devices, and combinations thereof via at least one of the group consisting of a modem, an Internet interface, and combinations thereof.

47. A method according to claim 27, said method further comprising:

automatically transmitted alarms to facility personnel via at least one of the group consisting of printing said alarm, electronically mailing said alarm, transmission of said alarm to a paging system.

* * * * *